US011805847B2

(12) United States Patent
Stewart

(10) Patent No.: US 11,805,847 B2
(45) **Date of Patent: *Nov. 7, 2023**

(54) FOOTWEAR WITH ENHANCED TOE POST

(71) Applicant: HARI MARI LLC, Dallas, TX (US)

(72) Inventor: Jeremy Carl Stewart, Dallas, TX (US)

(73) Assignee: HARI MARI LLC, Dallas, TX (US)

( * ) Notice: Subject to any disclaimer, the term of this patent is extended or adjusted under 35 U.S.C. 154(b) by 220 days.

This patent is subject to a terminal disclaimer.

(21) Appl. No.: 17/186,586

(22) Filed: Feb. 26, 2021

(65) Prior Publication Data

US 2021/0177094 A1 Jun. 17, 2021

Related U.S. Application Data

(63) Continuation of application No. 16/129,357, filed on Sep. 12, 2018, now Pat. No. 10,932,525, which is a continuation of application No. 13/840,463, filed on Mar. 15, 2013, now Pat. No. 10,098,415.

(60) Provisional application No. 61/614,331, filed on Mar. 22, 2012.

(51) Int. Cl.

| | |
|---|---|
| ***A43B 23/00*** | (2006.01) |
| ***A43B 3/12*** | (2006.01) |
| ***A43B 3/10*** | (2006.01) |

(52) U.S. Cl.

CPC ..... *A43B 23/00* (2013.01); *A43B 3/103* (2013.01); *A43B 3/105* (2013.01); *A43B 3/12* (2013.01)

(58) Field of Classification Search

None

See application file for complete search history.

(56) References Cited

U.S. PATENT DOCUMENTS

| | | | | |
|---|---|---|---|---|
| 2,928,191 | A | 8/1958 | Meltzer | |
| 2,947,095 | A | 8/1960 | Miyachi | |
| 3,928,927 | A | 12/1975 | Brown et al. | |
| 4,584,782 | A | 4/1986 | Thatcher | |
| 7,681,331 | B2 * | 3/2010 | Bathum | A43B 13/36 36/11.5 |
| 7,694,436 | B2 | 4/2010 | Mullen | |
| 7,980,005 | B1 * | 7/2011 | Young | A43B 3/10 36/94 |
| 8,336,228 | B2 | 12/2012 | Lonsway et al. | |
| 8,806,783 | B2 | 8/2014 | Chase et al. | |
| 10,098,415 | B2 | 10/2018 | Stewart | |
| 2001/0042271 | A1 * | 11/2001 | Pearce | A47C 27/00 5/652 |
| 2002/0121030 | A1 * | 9/2002 | Coleman | A43B 3/105 36/94 |

(Continued)

OTHER PUBLICATIONS

Filing receipt and specification for provisional patent application entitled "Footwear With Enhanced Toe Post," by Jeremy Stewart, filed Mar. 22, 2012 as U.S. Appl. No. 61/614,331.

*Primary Examiner* — Jila M Mohandesi

(74) *Attorney, Agent, or Firm* — NorthStar Law Group

(57) ABSTRACT

According to the various embodiments of the present disclosure, footwear with an enhanced toe post is provided. In an exemplary embodiment, the footwear may comprise a sole portion to support and protect a wearer's foot, a strap portion attached to the sole to bind the footwear to a wearer's foot, and at least one toe post passing between a wearer's toes constructed at least partially of memory foam or other cushioning materials.

20 Claims, 10 Drawing Sheets

(56) References Cited

U.S. PATENT DOCUMENTS

| | | | | |
|---|---|---|---|---|
| 2004/0168346 | A1* | 9/2004 | Boncutter | A43B 5/08 36/8.1 |
| 2005/0150132 | A1* | 7/2005 | Iannacone | A43B 3/105 36/11.5 |
| 2006/0210751 | A1 | 9/2006 | Cunningham | |
| 2007/0086825 | A1 | 4/2007 | Min | |
| 2007/0163048 | A1 | 7/2007 | Kimball | |
| 2007/0220777 | A1 | 9/2007 | Richardson | |
| 2008/0000107 | A1 | 1/2008 | Styles | |
| 2009/0320325 | A1 | 12/2009 | Escario | |
| 2010/0024247 | A1* | 2/2010 | Feeney | A43B 3/105 36/94 |
| 2011/0314694 | A1 | 12/2011 | Marmar et al. | |
| 2012/0304499 | A1* | 12/2012 | Kiesel | A43B 23/25 36/136 |

* cited by examiner

FOOTWEAR WITH ENHANCED TOE POST

CROSS-REFERENCE TO RELATED APPLICATION

This application is a continuation application of, and claims priority to, U.S. patent application Ser. No. 16/129,357, filed Sep. 12, 2018, now U.S. Pat. No. 10,932,525, which is a continuation of U.S. patent application Ser. No. 13/840,463 filed Mar. 15, 2013, now U.S. Pat. No. 10,098,415, which claims the benefit of U.S. Provisional Application No. 61/614,331, filed Mar. 22, 2012, the substance of each prior application is incorporated herein in its entirety to the extent it does not conflict with the below disclosure.

FIELD OF THE DISCLOSURE

The present invention relates to a piece of footwear with an enhanced toe post.

BACKGROUND OF THE DISCLOSURE

Some estimates suggest footwear was first used as early as 40,000 years ago. In modern times, footwear is essential but wearers often experience discomfort. Flip flops offer a comfortable, casual footwear choice to the modern footwear shopper. The toe portion of current flip flops and other types of footwear, however, often causes discomfort, abrasion, blistering, and fatigue.

BRIEF DESCRIPTION OF THE DRAWINGS

Various embodiments of the present disclosure, together with further objects and advantages, may best be understood by reference to the following description taken in conjunction with the accompanying drawings, in the several Figures of which like reference numerals identify like elements, and in which.

DETAILED DESCRIPTION OF THE EMBODIMENTS

Figures 1A, 1B, 1C:
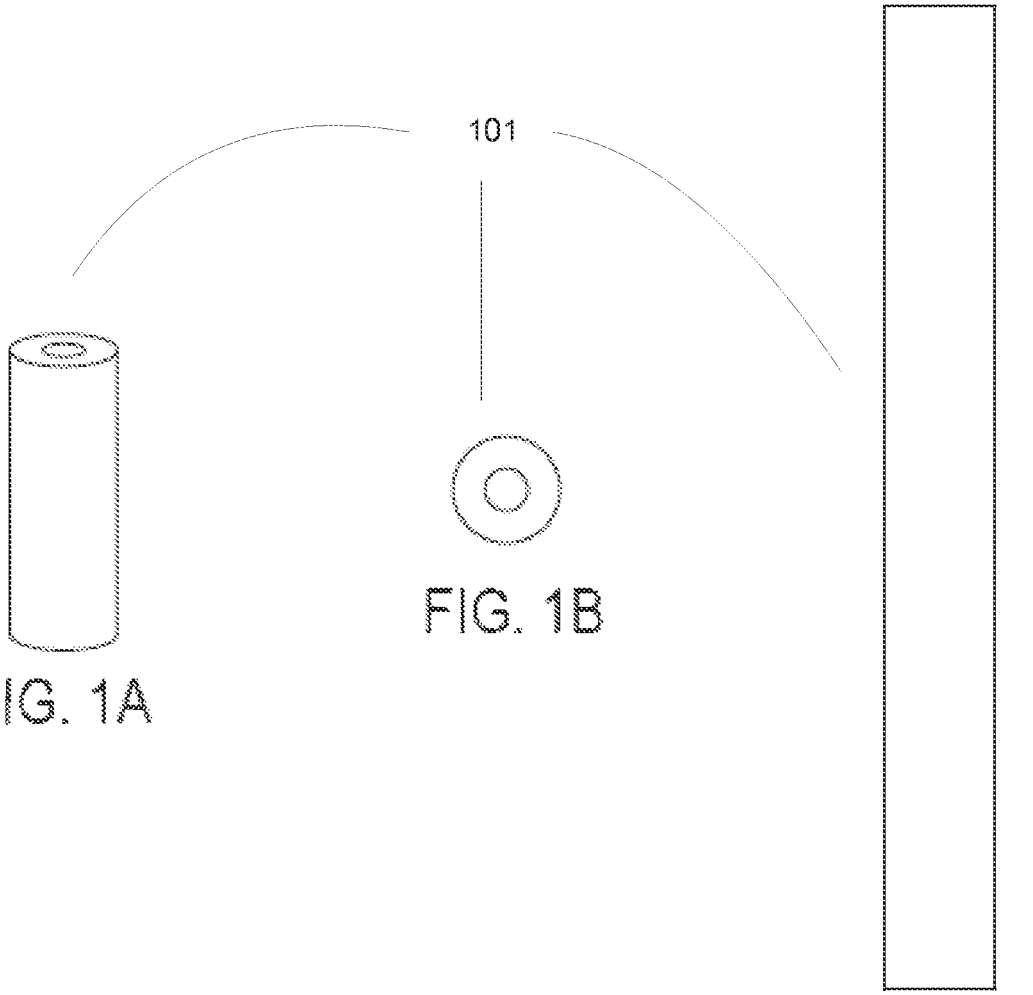
FIGS. 1A-1C depict an exemplary embodiment of a piece of footwear with a memory foam toe post.

The following description is intended to convey a thorough understanding of the embodiments described by providing a number of specific exemplary embodiments and details involving footwear with enhanced toe posts. It should be appreciated, however, that the present disclosure is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

According to the various embodiments of the present disclosure, footwear with an enhanced toe post is provided. In an exemplary embodiment, the footwear may comprise a sole portion to support and protect a wearer's foot, a strap portion attached to the sole to bind the footwear to a wearer's foot, and at least one toe post passing between a wearer's toes constructed at least partially of memory foam or similar materials.

The footwear sole may comprise at least one protective layer formed in a shape that will support a wearer's foot. The sole may be made out of any suitable material, including but not limited to rubber, thermoplastic elastomer, foam, XPS foam, quantum foam, polyurethane foam, polystyrene, phenolic, thermoplastic rubber, thermoplastic olefin, hemp, nylon, canvas, cotton, leather, elastane, neoprene, aerogel, nanofoam, ethylene-vinyl acetate, memory foam, gel, microfiber, any similar material, or any combination of those or similar materials. The sole may further comprise multiple layers imposed upon one another. For example and not by way of limitation, the sole may comprise layers of a thermoplastic rubber outsole (or bottom layer), a rubber/ethylene-vinyl acetate blend midsole (or middle layer), and a hemp blend insole. The sole may also comprise any other advantageous combination of materials.

The footwear strap or straps may be attached to the sole. The strap may comprise separate left and right portions. It should be understood that although "strap" is used in the singular throughout this application, the "strap" may optionally comprise a plurality of straps, and additionally, each strap may comprise multiple interconnected portions. A strap may form a v-shape, x-shape, straight line, parallel lines, or any other advantageous arrangement. The strap may be attached at an angle to conform to the shape of a wearer's foot. The strap may be comprised of multiple pieces of material attached to one another. The strap may be made out of any suitable mated al, including but not limited to rubber, thermoplastic elastomer, thermoplastic rubber, thermoplastic olefin, hemp, nylon, canvas, cotton, leather, elastane, neoprene, ethylene-vinyl acetate, memory foam, gel, microfiber, any similar material, or any combination of those or similar materials. For example and not by way of limitation, the strap may comprise a top layer of cotton blend material, a bottom layer of canvas blend material.

The footwear toe post may be attached to the sole and/or the strap. The toe post may comprise multiple pieces of material attached or disposed proximate to one another. The toe post may be made out of any suitable material, including but not limited to rubber, thermoplastic elastomer, foam, XPS foam, quantum foam, polyurethane foam, polystyrene, phenolic, thermoplastic rubber, thermoplastic olefin, hemp, nylon, canvas, cotton, leather, elastane, neoprene, aerogel, nanofoam, ethylene-vinyl acetate, memory foam, gel, microfiber, any similar material, or any combination of those or similar materials. For example and not by way of limitation, the toe post may comprise additional padding and/or layers of material to enhance comfort. In an exemplary embodiment, the toe post may comprise nylon ribbon and a sheath. The sheath may comprise a layer of microfiber lined with memory foam. Additionally, a layer of memory foam may be sewn into the nylon ribbon. The layer of memory foam in the ribbon may be denser than the memory foam lining the sheath. The sheath may be placed over a portion of the nylon ribbon. The toe post may be glued, stitched, or otherwise attached to the sole at some point in the sole, optionally below the insole layer. Further, a toe post may comprise at least one piece of memory foam or other padding or material embedded or fixed within a toe fabric portion.

In an exemplary embodiment, the toe post may comprise a layer of memory foam at least partially wrapped in a spandex with foam covering, with ribbon webbing on one side of the post.

In an exemplary embodiment, the toe post may comprise a nylon webbing ribbon, at least a portion of which is tubular. The toe post may further comprise a cylindrical-shaped portion of memory foam material, which may be inserted into the tubular portion of nylon webbing. The nylon webbing may optionally be stitched, glued, or otherwise fastened to fix the position of the memory foam material. The ribbon may have a flat portion to securely attach the ribbon to the sole, and may comprise a continuous portion that serves to attach the ribbon to the strap. Further, the ribbon may have a flat portion to securely attach the ribbon to the strap. Additionally, the ribbon may be a continuous portion of material or multiple portions of material fixed together.

In an exemplary embodiment, the toe post may comprise a foam and spandex pad. The pad may comprise a molded portion of memory foam or other material covered in at least one layer of spandex. The pad may then be wrapped around a spandex tubular support.

In an exemplary embodiment, the toe post may comprise a nylon webbing ribbon, at least a portion of which is tubular. The toe post may further comprise a plurality of memory foam beads, which may be inserted into the tubular portion of nylon webbing. The nylon webbing may optionally be stitched, glued, or otherwise fastened to fix the position of the memory foam beads. The ribbon may have a flat portion to securely attach the ribbon to the sole, and may comprise a continuous portion that serves to attach the ribbon to the strap. Additionally, the ribbon may be attached to the strap otherwise. In an exemplary embodiment, the ribbon may be embedded under a strap lining. The strap lining may be made out of any suitable material, including but not limited to rubber, thermoplastic elastomer, foam, XPS foam, quantum foam, polyurethane foam, polystyrene, phenolic, thermoplastic rubber, thermoplastic olefin, hemp, nylon, canvas, cotton, leather, elastane, neoprene, aerogel, nanofoam, ethylene-vinyl acetate, memory foam, gel, microfiber, any similar material, or any combination of those or similar materials.

In an exemplary embodiment, the toe post may comprise a molded toe post comprised of foam, gel, memory foam, or other suitable material. The toe post may comprise an internal support post molded from TPU, foam, or other suitable material. The toe post may comprise a molded attachment portion to be embedded in the sole.

In an exemplary embodiment, the toe post may comprise layer of memory foam. The layer of memory foam may be encased in a layer of webbing or other suitable material and a layer of microfiber or other suitable material. A layer of glue film may be used to bind the layers. Additionally, heat welding may be used to bind the layers. The toe post may optionally have at least one continuous portion for attachment to the sole and at least one continuous portion for attachment to the strap. Additionally, the toe post ay comprise a cap to cover the portion of the post that overlaps the strap.

In an exemplary embodiment, the toe post may comprise a rolled portion of memory foam. Additionally, the memory foam portion may be molded or otherwise constructed. The toe post may further comprise a ribbon. The ribbon may optionally be folded at one or more portions of the ribbon. The ribbon may be stitched so as to encase the memory foam portion. The toe post may further comprise a sheath. The sheath may comprise high-test nylon or other suitable material. The sheath may be a portion of material stitched to form a tube or may be a continuous tubular shaped portion of material. The ribbon may be inserted into the sheath, and the sheath may be sewn to the ribbon to fix its position. The sheath and ribbon may extend below the sole to be securely attached.

In an exemplary embodiment, the toe post may comprise a memory foam cylinder and a portion of ribbon material. The ribbon material may be made from webbing, nylon, or any other suitable material. The ribbon material may be tubular, flat, or have both tubular and flat portions. In an exemplary embodiment, a flat portion of the ribbon material may be stitched to the strap. A tubular portion of the ribbon material may extend beyond that strap. The ribbon material may comprise stitching or other mechanisms to attach the toe post to the strap. The cylinder may be inserted into the tubular portion. The ribbon material may be stitched or otherwise bound to fix the position of the cylinder.

In an exemplary embodiment, the toe post may comprise a memory foam cylinder and a portion of ribbon material. The ribbon material may be made from webbing, nylon, or any other suitable material. The ribbon material may be tubular, flat, or have both tubular and flat portions. In an exemplary embodiment, a flat portion of the ribbon material may be stitched to the strap. A tubular portion of the ribbon material may extend beyond that strap. The ribbon material may comprise stitching or other mechanisms to attach the toe post to the strap. The cylinder may be inserted into the tubular portion. The ribbon material may be stitched or otherwise bound to fix the position of the cylinder.

In an exemplary embodiment, the toe post may comprise a plurality of memory foam beads and a portion of ribbon material. The ribbon material may be made from webbing, nylon, or any other suitable material. The ribbon material may be tubular, flat, or have both tubular and flat portions. In an exemplary embodiment, a flat portion of the ribbon material may be stitched to the strap. A tubular portion of the ribbon material may extend beyond that strap. The ribbon material may comprise stitching or other mechanisms to attach the toe post to the strap. The memory foam beads may be inserted into the tubular portion. The ribbon material may be stitched or otherwise bound to fix the position of the memory foam beads.

In an exemplary embodiment, the toe post may comprise a sheath. The sheath may comprise an external material lined with memory foam or any other suitable material. The external portion of the sheath may comprise microfiber or any other suitable material. The sheath may be stitched to form a tubular shape, or may be manufactured as one tubular shape. The toe post may further comprise a portion of memory foam encased in a ribbon material. The ribbon material may be inserted into the sheath. The ribbon material may optionally be folded before insertion. The ribbon material may have a portion to extend beyond the sole. The ribbon material may then be inserted through a portion of the sole before the sole is fully constructed. The ribbon material may then be fixed between at least two layers of the sole.

Figure 2:
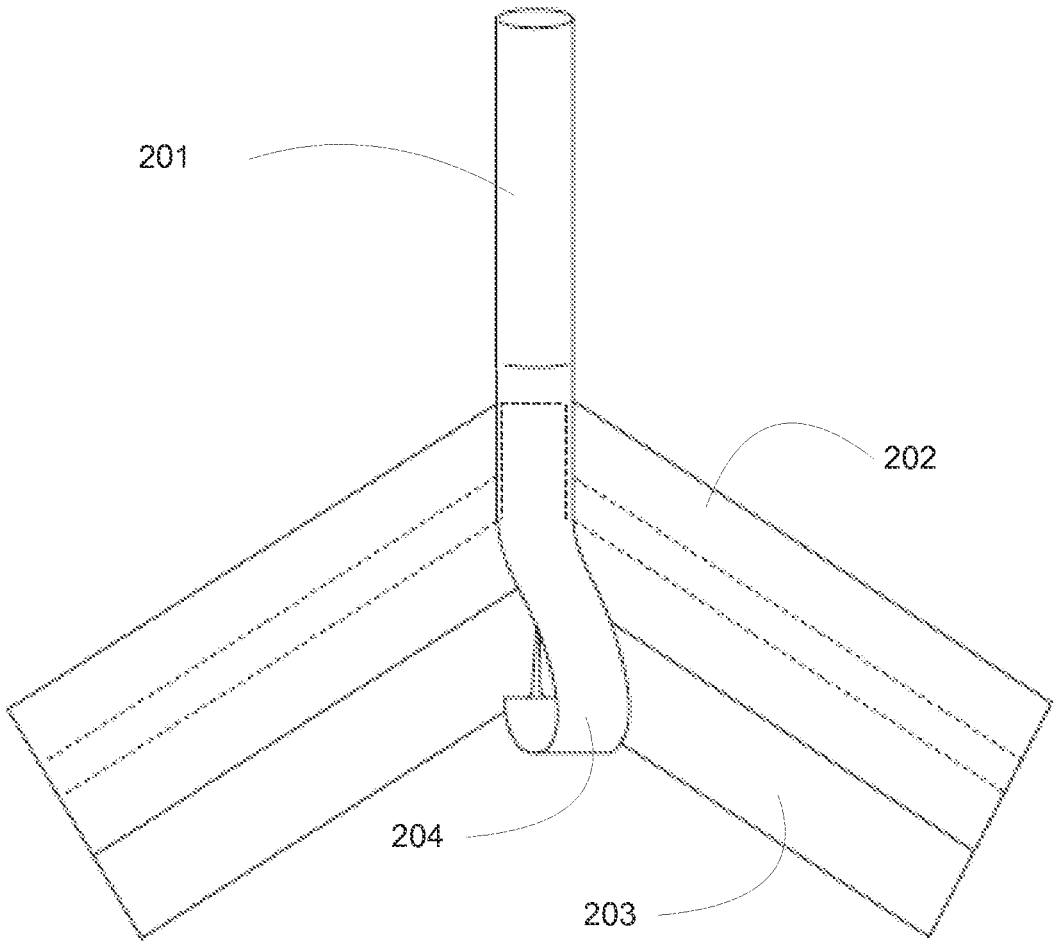
FIG. 2 depicts an exemplary embodiment of a piece of footwear with a memory foam toe post.

FIGS. 1A, 1B, and 1C show alternate views of a memory foam cylinder 101. The cylinder may have a hollow center, but may also be perforated, solid, rounded edges, protrusions, or be formed in any other manner. The cylinder may also be made from any other material, as noted both above and below. Further, the cylinder may be a flat or other shaped piece of memory foam or other material rolled or otherwise formed into a cylindrical shape. FIG. 2 displays a toe fabric portion 201, a strap 202, and a lining 203. One end of the toe fabric portion 201, shown in FIG. 2 as attachment point 204, may be attached to the strap and/or lining. In an exemplary embodiment, the toe fabric portion 201 may be folded between the strap 202 webbing and lining 203. Additionally, the attachment point 204 may be attached to the strap under the lining so as to be covered, smoothed, or protected from wear. The lining 203 may be disposed on a skin-facing portion of the strap 202. In an exemplary embodiment, the lining 203 may be stitched to the strap 202 webbing after the toe fabric portion 201 has been folded between the strap 202 webbing and lining 203. The toe portion 201 may have a series of stitches or closures to create one or more stoppage points to aid in or secure the positioning of the memory foam cylinder 101. For example, there may be stitching in the toe fabric portion 201 both above and below the memory foam cylinder 101 position to fix the memory foam cylinder 101 in place.

Figure 3:
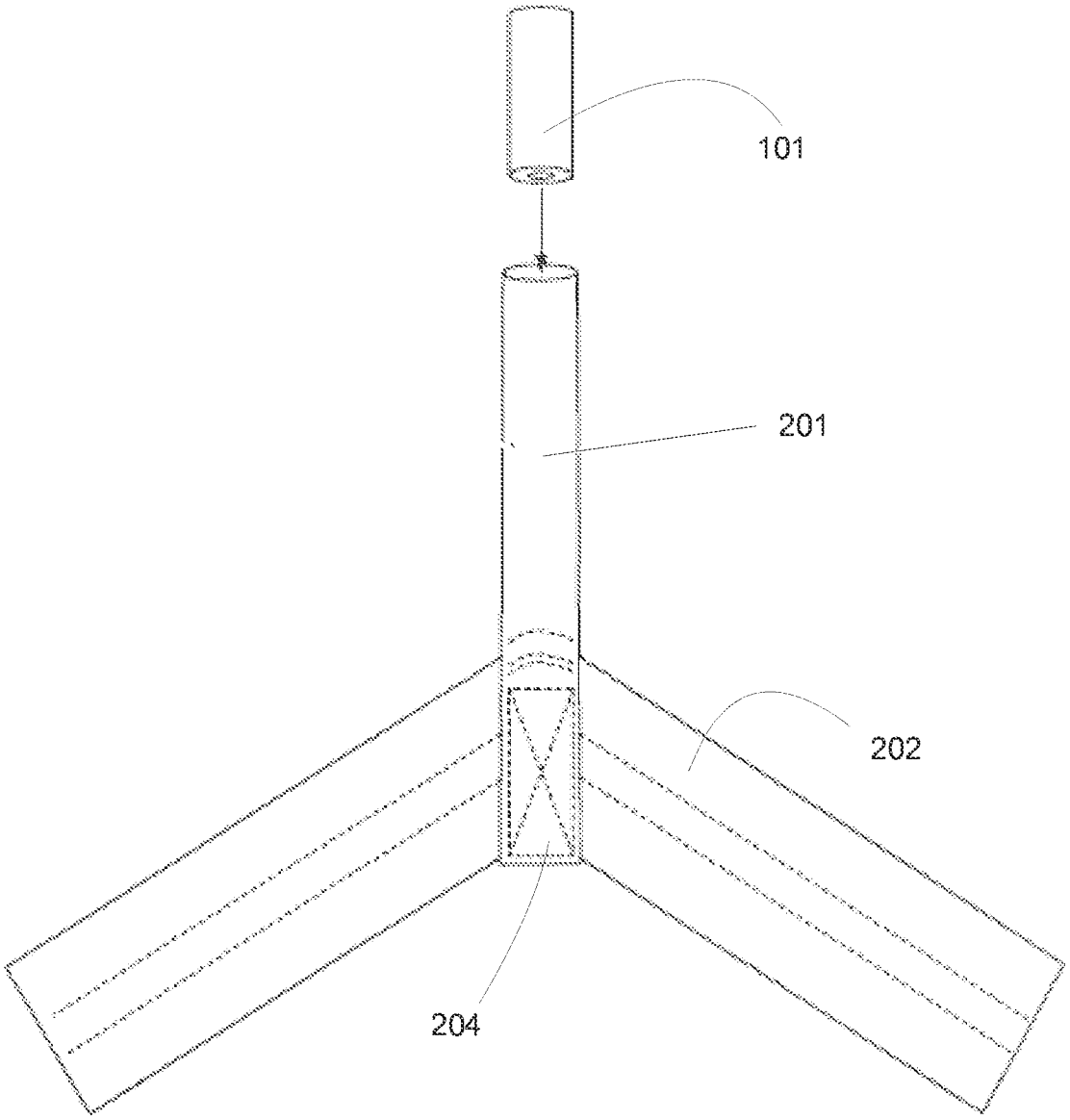
FIG. 3 depicts an exemplary embodiment of a piece of footwear with a memory foam toe post.
Figure 4:
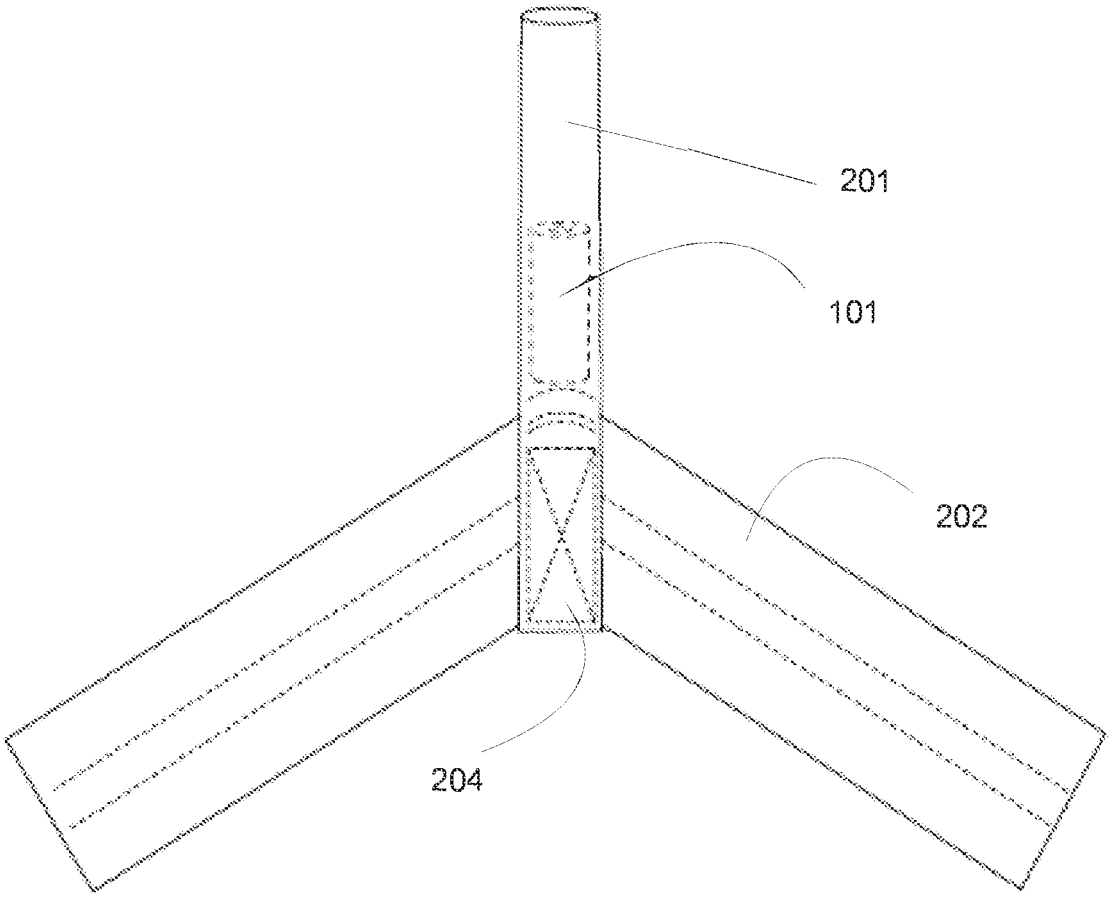
FIG. 4 depicts an exemplary embodiment of a piece of footwear with a memory foam toe post.
Figure 5D:
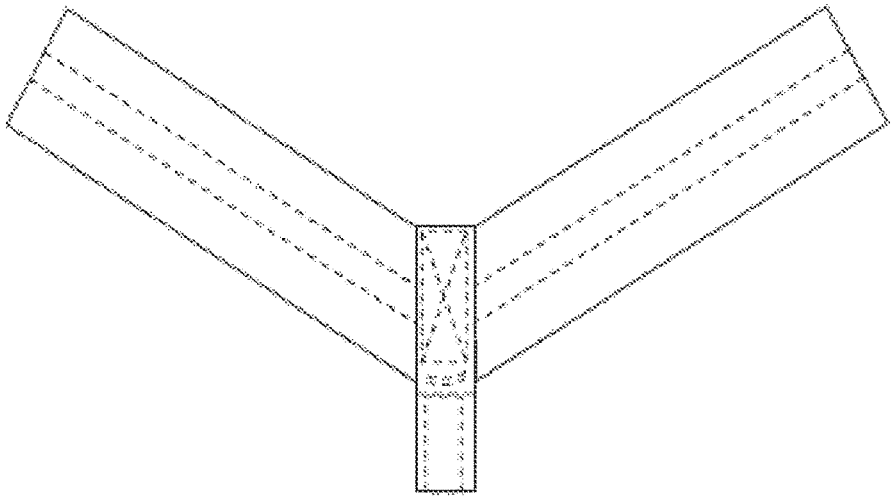
FIGS. 5A-5D depict an exemplary embodiment of a piece of footwear with a memory foam toe post.
Figure 5C:
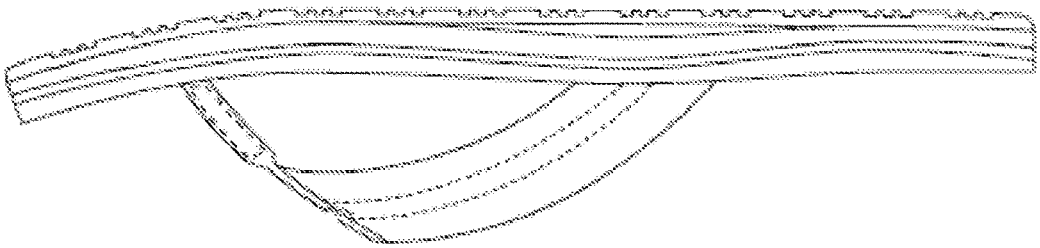
Figure 5B:
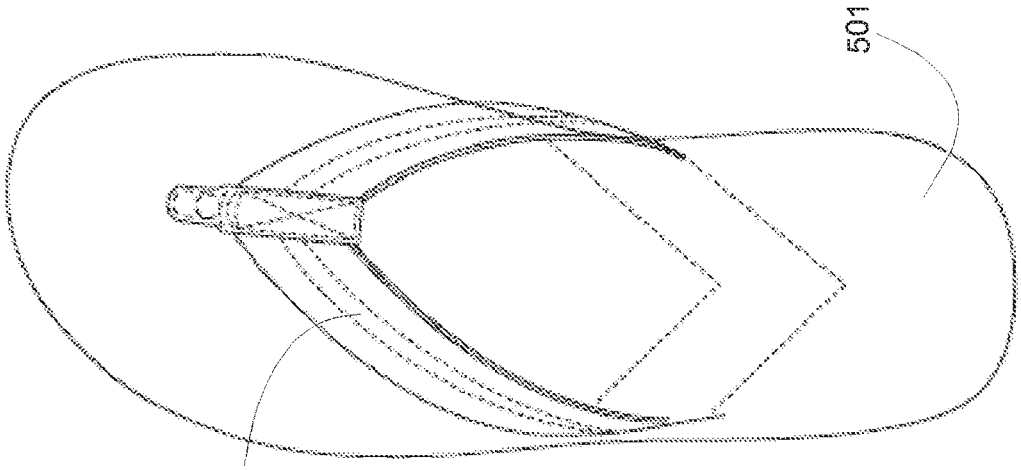
Figure 5A:
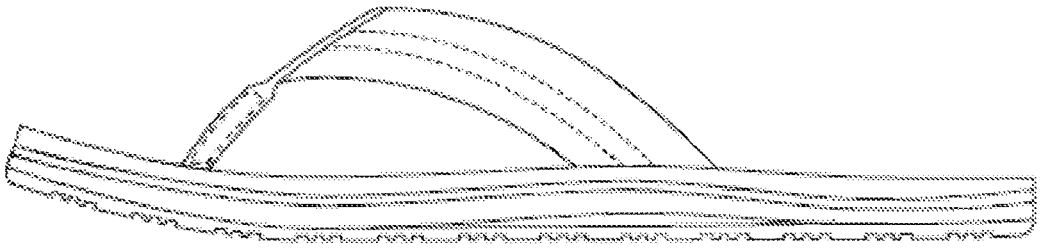

FIG. 3 displays an exemplary embodiment demonstrating how the cylinder 101 may be inserted into the toe fabric portion 201. FIG. 4 displays the cylinder 101 completely inserted into the toe fabric portion 201. FIGS. 5A-5C show side and top views of assembled footwear using a memory foam toe post. The 202 strap may be secured to the sole 501. In the exemplary embodiment displayed in 5B, the strap may continue between multiple layers of the sole as a manner of securing the strap to the sole.

Figure 6C:
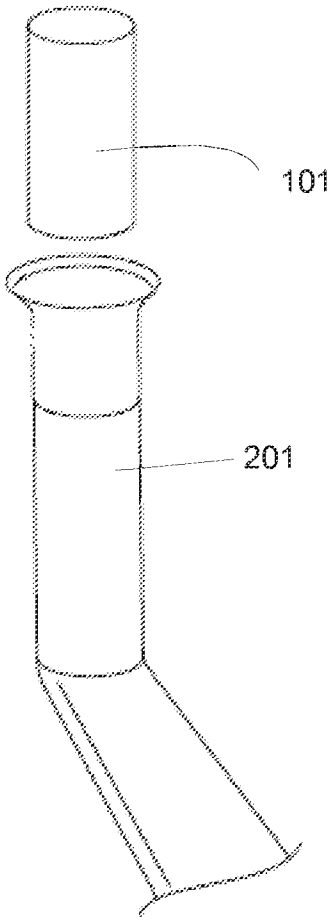
FIGS. 6A-6C depict an exemplary embodiment of a piece of footwear with a memory foam toe post.
Figure 6B:
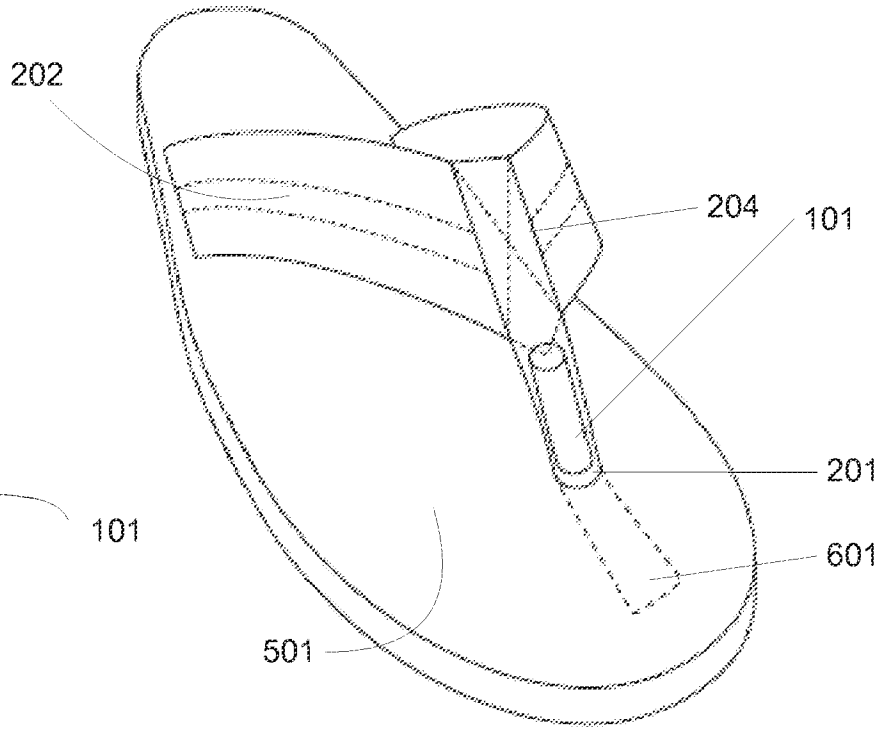
Figure 6A:
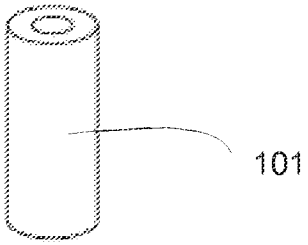

FIGS. 6A-6C further illustrate the memory foam cylinder 101 inserted into the toe fabric portion 201. A bottom end 601 of the toe portion fabric 201 may extend into the sole 501 and may be secured between a plurality of layers of the sole 501. The other end of the toe portion fabric 201 may be secured to the strap 202, forming attachment point 204. In an exemplary embodiment, the toe portion fabric 201 may comprise multiple portions of fabric or material connected or secured together and/or be fastened to other parts of the footwear in any beneficial way.

Figure 7A:
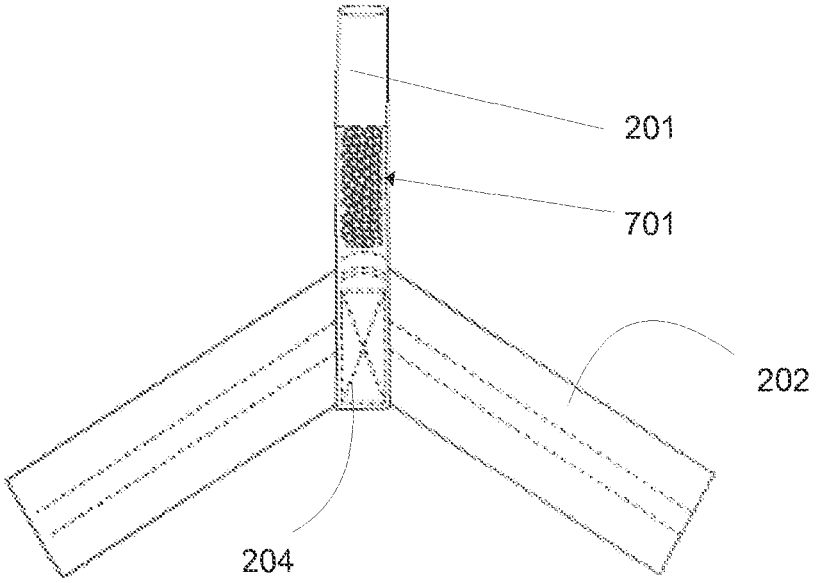
FIGS. 7A-7C depict an exemplary embodiment of a piece of footwear with a memory foam toe post.
Figure 7B:
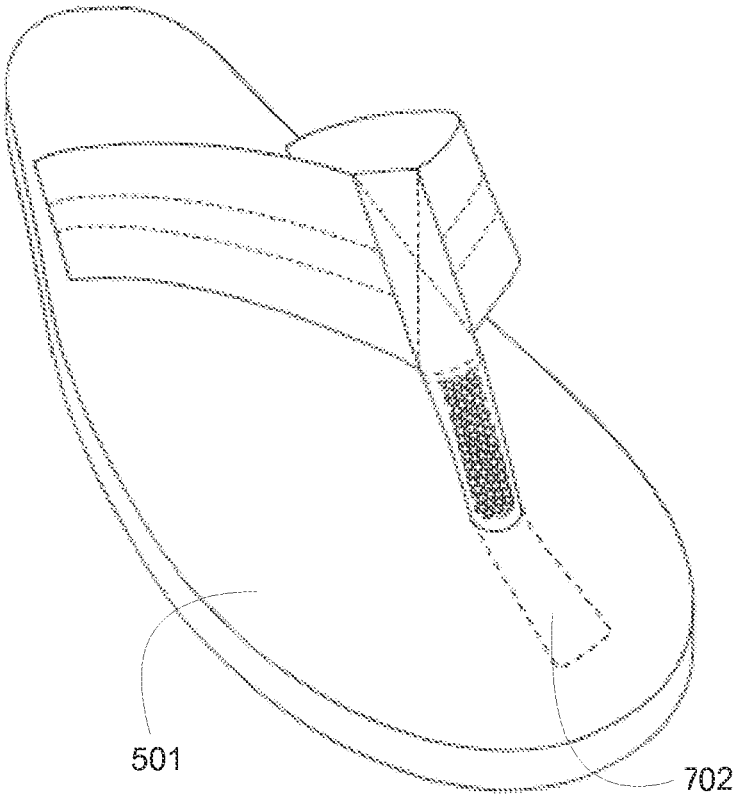
Figure 7C:
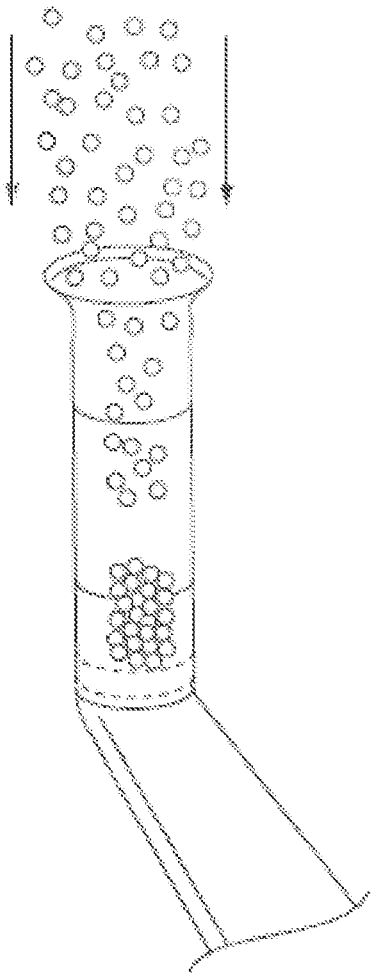
Figure 8A:
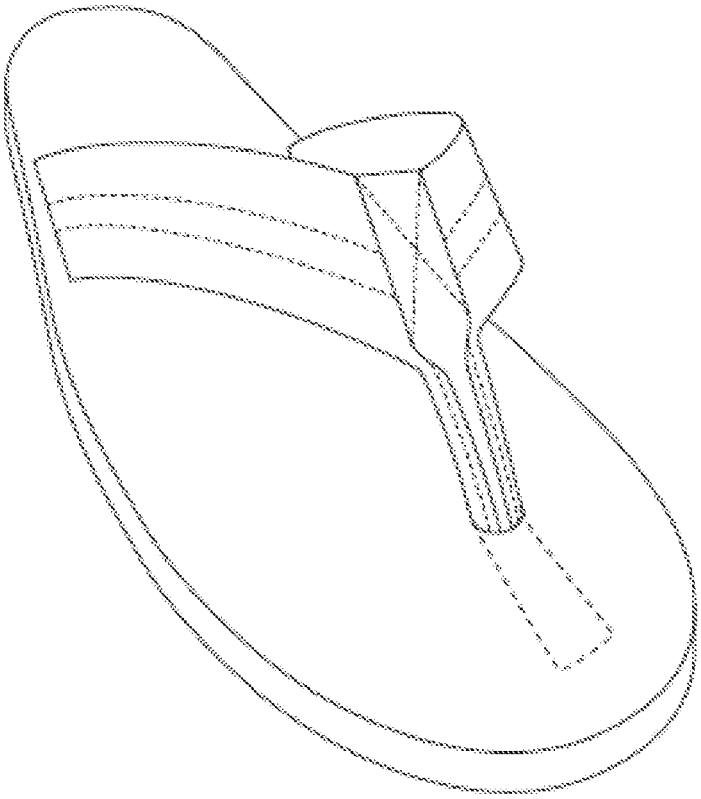
FIGS. 8A-8B depict an exemplary embodiment of a piece of footwear with a memory foam toe post.
Figure 8B:
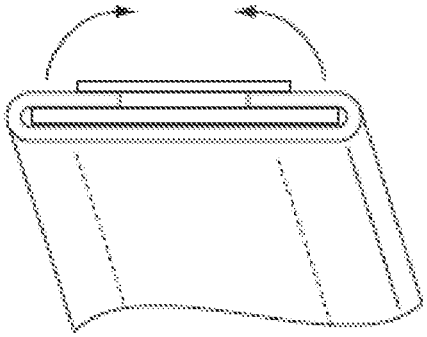
Figure 9A:
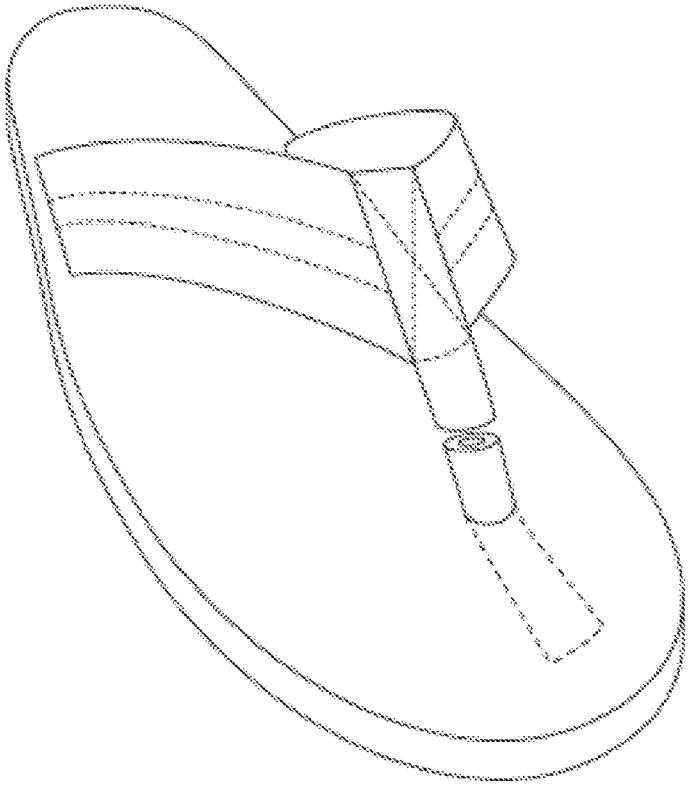
FIG. 9A-9C depict an exemplary embodiment of a piece of footwear with a memory foam toe post.
Figure 9B:
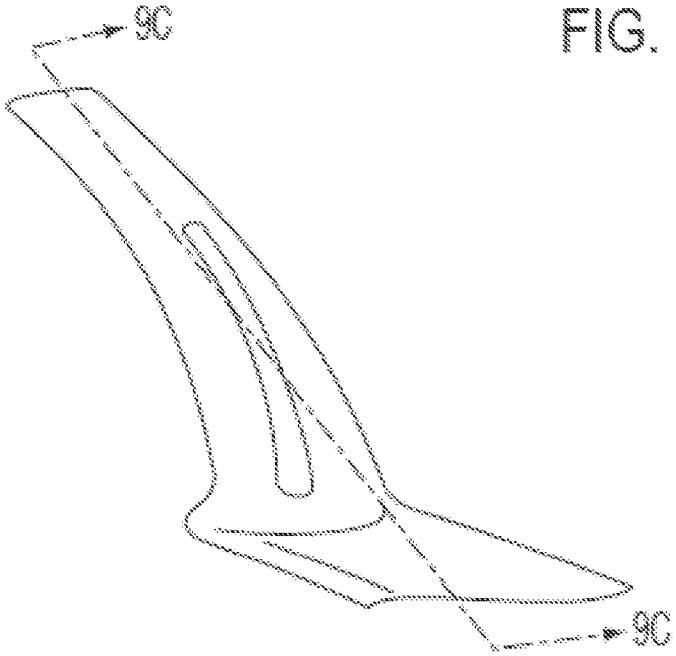
Figure 9C:
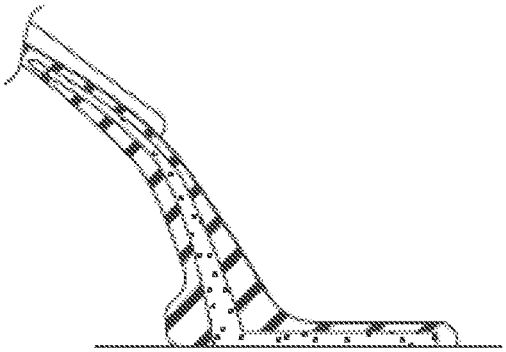
Figure 10A:
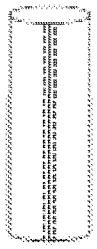
FIGS. 10A-10C depict an exemplary embodiment of a piece of footwear with a memory foam toe post.
Figure 10B:
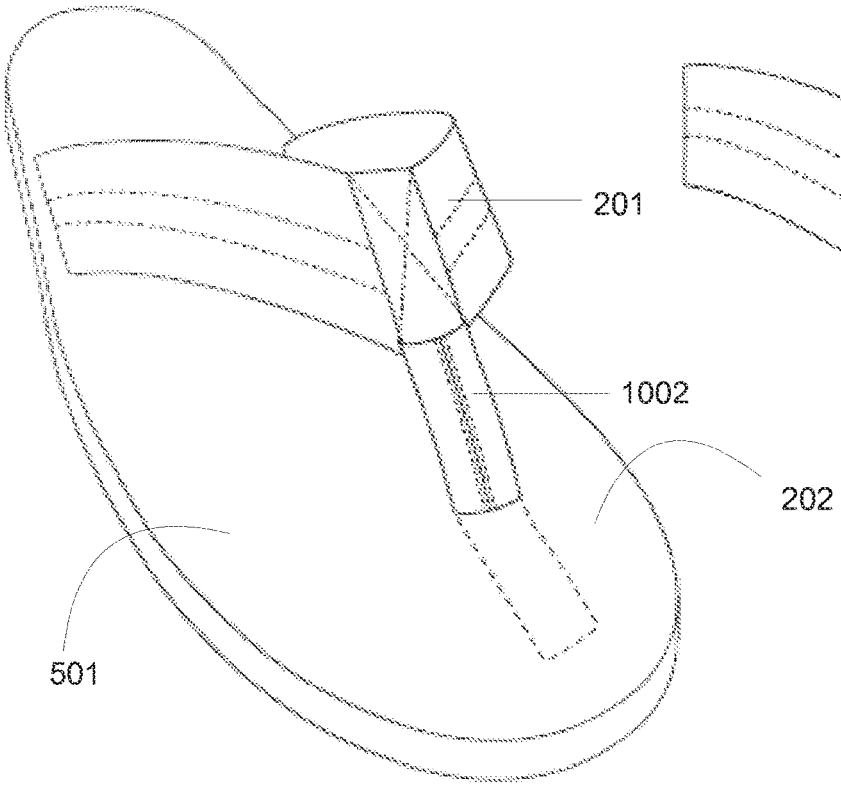
Figure 10C:
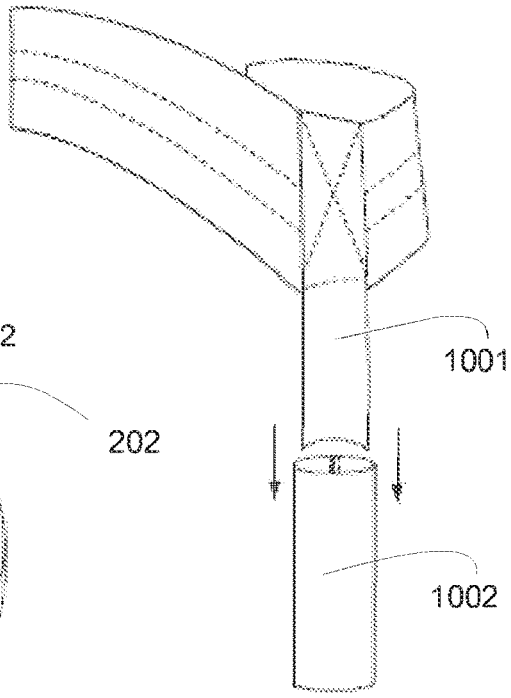

FIGS. 7A-7C show an exemplary embodiment of the footwear and toe post. A plurality of padding beats 701 may be inserted into the toe portion fabric 201, which may be secured to the strap 202 at attachment point 204. The toe portion fabric 201 may be attached to the sole 501 by embedding a bottom piece 702 of the toe portion fabric 201 into the sole 501 or by any other attachment means. FIGS. 8A-8B show an exemplary embodiment of the footwear and toe post, wherein the toe post may comprise a folded or rolled portion of padding. FIGS. 9A-9C show an exemplary embodiment of the footwear and toe post, wherein the toe post may comprise an injection molded padded portion, which may contain gel, memory foam, or other cushioning material. FIGS. 10A-10C show an exemplary embodiment of the footwear and toe post, wherein the toe post may comprise toe ribbon 1001 covered by a padded sheath 1002. The toe ribbon 1001 may also contain padding as described above or any be cushioned or padded in any other manner.

It should be noted that the above embodiments do not exclude each other and may be combined as desired. The various embodiments described above are fully compatible with one another and multiple portions from selected embodiments may be combined or deleted to fit consumer and technical demands. Additionally, it should be noted that although specified materials are used throughout the specification, each use is by example and not by way of limitation. The invention may use any material suitable for the embodiment. Further, although several exemplary embodiments describe footwear commonly known as flip flops, the invention is not limited to use in flip flops. The toe posts may be used in any circumstance where toe division or separation is used in footwear.

In the preceding specification, various preferred embodiments have been described with references to the accompanying drawings. It will, however, be evident that various modifications and changes may be made thereto, and additional embodiments may be implemented, without departing from the broader scope of the invention as set forth in the claims that follow. The specification and drawings are accordingly to be regarded as an illustrative rather than restrictive sense.

The invention claimed is:

1. An article of footwear, the footwear comprising:
- a sole including a top surface and one or more layers configured to support a foot of a wearer;
- a strap attached to the sole to bind the footwear to the foot of the wearer; and
- a toe post configured to pass between toes of the wearer, the toe post comprising:
  - a ribbon attached to, and continuously extending between, the sole and the strap, the ribbon comprising:
    - a bottom terminal portion attached to the sole below the top surface of the sole;
    - a top terminal portion folded around the strap and attached thereto at an attachment point; and
    - a hollow portion disposed between the bottom terminal portion and the top terminal portion, the hollow portion having a length that extends from at least the top surface of the sole to the strap; and
- padding contained throughout the length of the hollow portion of the ribbon.

2. The footwear of claim 1, wherein the hollow portion is contained within a tubular portion of the ribbon.

3. The footwear of claim 2, wherein the padding is cylindrical in shape and contained within the tubular portion.

4. The footwear of claim 1, wherein the padding includes memory foam.

5. The footwear of claim 1, wherein the padding includes a plurality of beads.

6. The footwear of claim 1, wherein the padding includes one or more of gel, rubber, thermoplastic elastomer, foam, polystyrene, phenolic, thermoplastic olefin, hemp, nylon, canvas, cotton, leather, elastane, neoprene, aerogel, nanofoam, ethylene-vinyl acetate, and microfiber.

7. The footwear of claim 1, wherein the bottom terminal portion is attached using one or more of glue and stitching.

8. The footwear of claim 1, wherein the ribbon is attached to the sole by embedding the bottom terminal portion into the sole.

9. The footwear of claim 1, wherein the bottom terminal portion is attached between at least two layers of the sole.

10. The footwear of claim 1, wherein the one or more layers of the sole include multiple layers imposed upon one another.

11. The footwear of claim 10, wherein the multiple layers of the sole include a bottom layer, a middle layer, and an insole defining the top surface.

12. The footwear of claim 1, wherein the strap is secured to the sole between layers of the sole.

13. The footwear of claim 1, further comprising a lining disposed on a skin-facing portion of the strap.

14. The footwear of claim 13, wherein the attachment point of the ribbon to the strap is on the lining.

15. The footwear of claim 13, wherein the top terminal portion of the ribbon is disposed between the strap and the lining.

16. The footwear of claim 13, wherein the lining is made from one or more of rubber, thermoplastic elastomer, foam, XPS foam, quantum foam, polyurethane foam, polystyrene, phenolic, thermoplastic rubber, thermoplastic olefin, hemp, nylon, canvas, cotton, leather, elastane, neoprene, aerogel, nanofoam, ethylene-vinyl acetate, memory foam, gel, and microfiber.

17. The footwear of claim 1, wherein one or more of the bottom terminal portion and the top terminal portion of the ribbon is flat.

18. The footwear of claim 1, wherein the ribbon is made of nylon webbing.

19. The footwear of claim 1, wherein the strap includes a top layer and a bottom layer, and wherein the top layer is made of a cotton blend material and the bottom layer is made of a canvas blend material.

20. An article of footwear, the footwear comprising:

a sole including a top surface and one or more layers configured to support a foot of a wearer;

a strap attached to the sole to bind the footwear to the foot of the wearer; and a toe post configured to pass between toes of the wearer, the toe post comprising:

a ribbon continuously extending between the sole and the strap, the ribbon comprising:

a bottom terminal portion attached to the sole below the top surface of the sole;

a top terminal portion folded around the strap; and a hollow portion disposed between the bottom terminal portion and the top terminal portion, the hollow portion having a length that extends from at least the top surface of the sole to the strap; and padding contained throughout the length of the hollow portion of the ribbon.

* * * * *